United States Patent [19]

Neri

[11] 4,262,393

[45] Apr. 21, 1981

[54] ADVERTISING CRAVAT HOLDER

[76] Inventor: Joseph R. Neri, 3101 Quentin Rd., Brooklyn, N.Y. 11234

[21] Appl. No.: 46,855

[22] Filed: Jun. 8, 1979

[51] Int. Cl.[3] ..... A41D 25/04

[52] U.S. Cl. ..... 24/49 CF; 2/145

[58] Field of Search ..... 24/DIG. 28, 49 CF, 49 A, 24/49 K, 49 R, 49 S, 49 TS, 56, 255 BS; 2/145, 156, 157

[56] References Cited

U.S. PATENT DOCUMENTS

| | | | |
|---|---|---|---|
| 2,024,085 | 12/1935 | Baer | 24/49 CF |
| 2,588,576 | 3/1952 | Roop et al. | 2/145 |
| 3,042,983 | 7/1962 | Riedler | 24/49 CF |
| 3,151,371 | 10/1964 | Ellestad | 24/56 |
| 3,381,865 | 5/1968 | Pehr | 2/145 X |

FOREIGN PATENT DOCUMENTS

| | | | |
|---|---|---|---|
| 1133706 | 11/1956 | France | 2/145 |
| 3984 | of 1911 | United Kingdom | 24/49 S |

*Primary Examiner*—Roy D. Frazier
*Assistant Examiner*—Peter A. Aschenbrenner
*Attorney, Agent, or Firm*—Richard L. Miller

[57] ABSTRACT

A necktie holder which at a same time also serves to display an advertisement or an identification card; the holder consisting of a flexible, thin sheet of transparent plastic that is die-cut with one set of slots for shirt buttons to fit therethrough, and another set of slots for a necktie to be threaded therethrough; the holder in one design being imprinted with an advertisement, and in another design being folded over so to enclose an identification card.

1 Claim, 6 Drawing Figures

ADVERTISING CRAVAT HOLDER

BACKGROUND OF THE INVENTION

This invention relates generally to necktie or cravat holders. More specifically it relates to display devices worn by a person.

It is well known that, in the past, numerous display devices for being worn by persons have been designed so as to be used particularly at conventions and the like where an organization name or symbol printed upon the device is displayed. Numerous other sash devices have been also designed so as to display the wearer's identification card or personal name so that the individual is thus recognized as an authorized member or person permitted entry and whose name is thus introduced to others.

SUMMARY OF THE INVENTION

It is a principal object of the present invention to provide such a display device which additionally serves the useful purpose of also holding a cravat or neckties.

Another object is to provide an advertising cravat holder which is very inexpensive to make so to be easily afforded by every organization.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF PREFERRED EMBODIMENT

Figure 1:
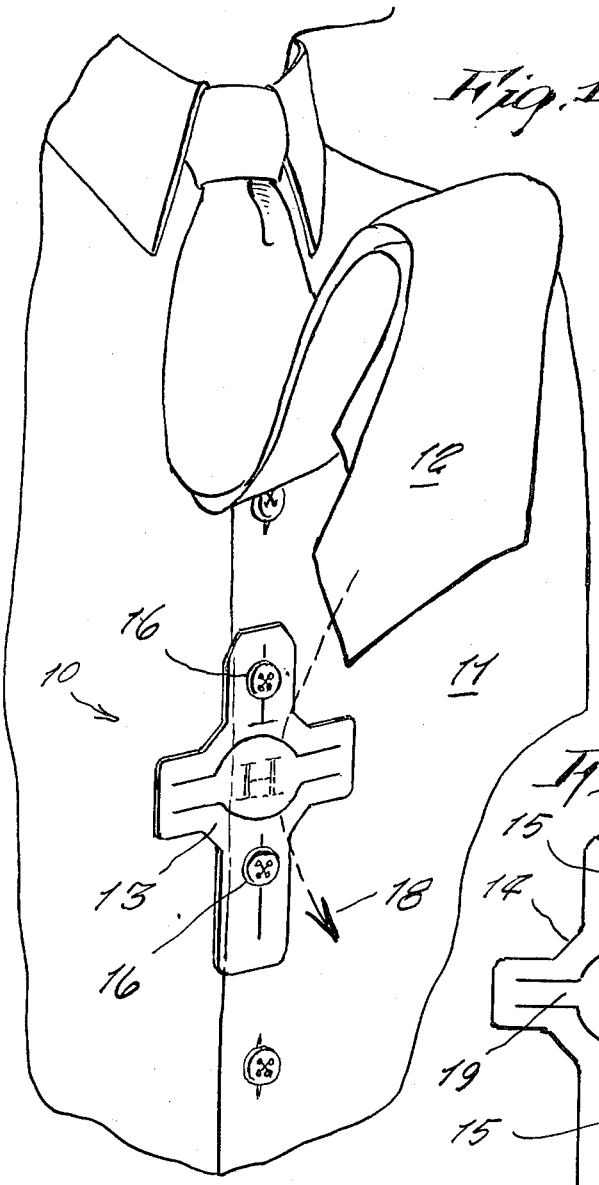
FIG. 1 is a perspective view of the invention installed on a shirt, and necktie positioned for being threaded therethrough.
Figure 2:
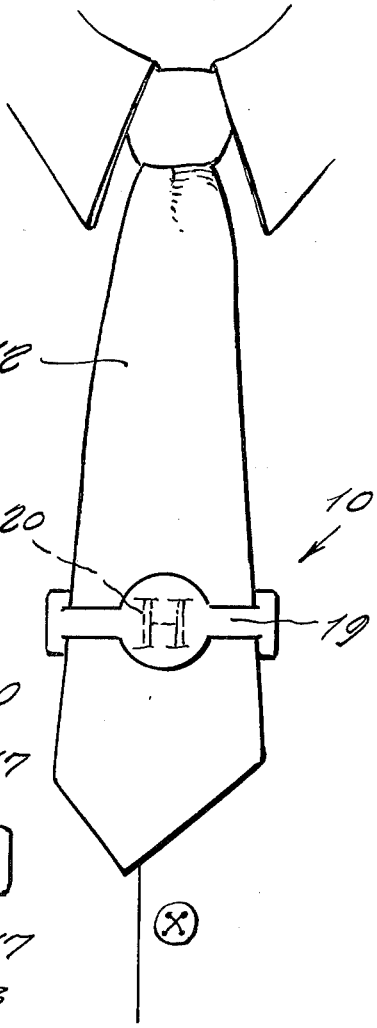
FIG. 2 is a front view thereof with necktie installed therein.
Figure 3:
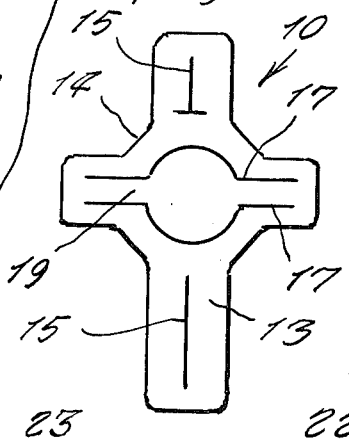
FIG. 3 is a front view of the invention shown in FIG. 1, the device being a two button model.

Referring now to the drawing in greater detail, and more particularly to FIGS. 1, 2 and 3 thereof at this time, the reference numeral 10 represents an advertising cravet holder according to the present invention, wherein the same is compressed of a single thin sheet of transparent plastic that is generally regarded as stiff so that it holds its flat shape, but which is sufficiently flexible in order that it may be bent when attached to a wearer's shirt 11 and necktie 12.

The plastic sheet 13 is die-cut with a peripheral edge 14 of any desired shape. A pair of linear aligned slots 15 die-cut therein serve for shirt buttons 16 to be threaded therethrough. Another pair of parallel cross slots 17 are transverse to the slots 15 serve for the necktie to be threaded therethrough, as shown by arrow 18, so that the necktie passes behind an intermediate tongue portion 19 formed between the slots 17, and thus permits view of any advertisement sign, symbol or text 20 printed thereupon. As shown, the cross slots 17 may likewise be irregularly die-cut, as wished.

In use, the device is first secured behind the shirt buttons, after which the neckties is then fitted through.

Figure 4:
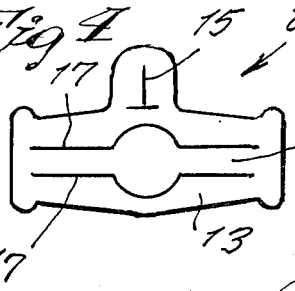
FIG. 4 is a front view of a single button model.

In FIG. 4, another design of holder 21 is the same as holder 10 except that it is made with only a single slot 15 so that it attaches to only one button, instead of two buttons.

Figure 5:
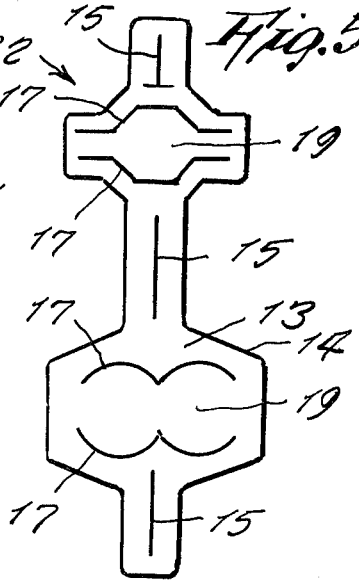
FIG. 5 is a front view of a three button model.

In FIG. 5, another design of holder 22 is also the same as holder 10, except that it has three slots 15 so as to fit around three buttons, and it also includes two tongue portions 19 in order to display more advertising.

Figure 6:
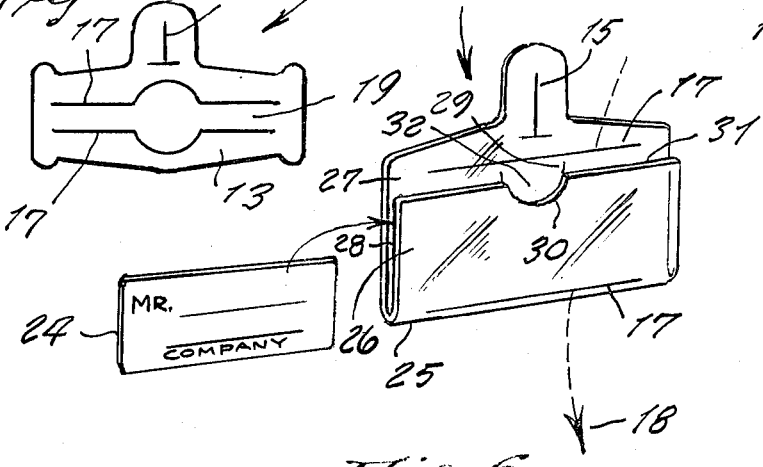
FIG. 6 is a perspective view of still another model made of clear plastic, to hold an I.D. card.

In FIG. 6, still another design of holder 23 is designed for an identification card 24 to be inserted therein. It comprises a transparent plastic sheet 13 having a transverse, horizontal bend 25 thereacross so that a lower portion thereof is folded flat in front of an upper portion thereof, so as to form front and rear sides 26 and 27 respectively, having a space 28 therebetween into which the card is inserted, so as to be visible through the side 26 in front thereof.

Prior to making the folding bend 25, the sheet is die-cut with the single button slot 15 and two horizontal cross slots 17 for the necktie. The folding bend 25 is then made near the lower cross slot 17 so that this cross slot is on the front side of the holder. After the bend 25 is made, a semi-circular die-cut slot 29 through both front and rear sides 26 and 27 is made so that a notch 30 is thus produced along an upper edge 31 of the front side, and a semi-circular tab 32 is formed on the rear side. As shown in FIG. 6, the semi-circular slots in the front and rear walls, are aligned together, indicating that they may be struck out by a single die in one operation. The tab thus produced, is forwardly pushed into the notch when inserting a card so that the tab then rests against a front side of the inserted card and locks it in from failing out of a top in case a person bends over. Advertising may be printed on front side 26 is placed where it will not interfer with reading of the person's name.

In addition depending upon the stiffness of the material it may be desirable to heat seal or otherwise seam edge at space 28.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. An advertising cravat holder, comprising in combination, a flat sheet of transparent plastic die-cut with at least one slot for receiving a shirt button therethrough, at least one pair of cross slots for threading a necktie therethrough, and space where advertising may be printed on said sheet; a horizontal transverse bend thereacross, a lower portion of said flat sheet being folded flat in front of an upper portion thereof, a space pocket therebetween, where a card may be inserted into said space so as to be visible therein, said lower portion thus forming a front side and said upper portion thus forming a rear side of said cravat holder, a semi-circular die-cut slot through both said front and rear sides, said die-cut slot on said front side forming a notch along an upper edge of said front side, and forming a semi circular tab on said rear side, said tab being forwardly pushed into said notch so that said tab rests across at top edge of said card, locking said card from falling out a top of said pocket.

* * * * *